US006504513B1

(12) United States Patent
Tryer et al.

(10) Patent No.: US 6,504,513 B1
(45) Date of Patent: Jan. 7, 2003

(54) ELECTRONIC ARTICLE SURVEILLANCE ANTENNA COILS WITH VARIABLE WIND GEOMETRY

(75) Inventors: Mark Tryer, Boca Raton, FL (US); Franklin H. Valade, Jr., Boynton Beach, FL (US); Gilbert Fernandez, Weston, FL (US); Pedro Lopez, Miami, FL (US); Dale W. Raymond, Boca Raton, FL (US)

(73) Assignee: Sensormatic Electronics Corporation, Boca Raton, FL (US)

( * ) Notice: Subject to any disclaimer, the term of this patent is extended or adjusted under 35 U.S.C. 154(b) by 0 days.

(21) Appl. No.: 09/921,661

(22) Filed: Aug. 3, 2001

(51) Int. Cl.[7] ..... H01Q 11/12
(52) U.S. Cl. ..... 343/742; 343/867; 340/572.7
(58) Field of Search ..... 343/741, 742, 343/866, 867; 340/551, 572.7

(56) References Cited

U.S. PATENT DOCUMENTS 4,745,401 A * 5/1988 Montean ..... 333/175
4,972,198 A * 11/1990 Feltz et al. ..... 340/572.7
4,999,641 A * 3/1991 Cordery et al. ..... 343/742
5,404,147 A * 4/1995 Drucker et al. ..... 340/572.7
5,459,451 A * 10/1995 Crossfield et al. ..... 340/551
5,825,291 A * 10/1998 Platt et al. ..... 340/571
6,118,378 A * 9/2000 Balch et al. ..... 340/572.7

* cited by examiner

*Primary Examiner*—Tan Ho
(74) *Attorney, Agent, or Firm*—Rick F. Comoglio

(57) ABSTRACT

An EAS antenna having uniform antenna thickness along the antenna height is provided. The antenna is contains at least two overlapping coils where the individual coil cross-sections are variable with respect to the circumference. If the individual coil thickness is halved at the overlap, the antenna will have uniform thickness along the antenna height. This is accomplished by reducing the number of wire turns per layer along one or more sections of the coil, and simultaneously increasing the number of wire layers on the same sections.

4 Claims, 2 Drawing Sheets

ELECTRONIC ARTICLE SURVEILLANCE ANTENNA COILS WITH VARIABLE WIND GEOMETRY

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

This invention relates to electronic article surveillance (EAS) antennas, and more particularly to EAS antennas using multiple loop coils having at least one overlapping section.

2. Description of the Related Art

In the high fashion retail marketplace, retailers have a strong preference for discreet electronic article system protection. In locations where electronic article surveillance antennas are required and must be visible to pedestrian traffic, it is advantageous to design the antennas to be as transparent as possible. Near transparency is achievable by developing "low visual mass" antennas, where the individual structural elements of the antenna are made as thin and sleek as possible. Having near transparent designs is a key market advantage in the high-end retail market.

Magnetomechanical EAS antennas can consist of one or more loops of coil wire adapted to transmit and receive preselected EAS frequencies. To optimize the detection performance of magnetomechanical EAS antennas, two coils are utilized, where the phase of each coil in the pair is reversed periodically during transmission, and the coil pairs overlap near the center of the antenna. Using conventional coil winding techniques, each antenna coil has a uniform cross-section, defined by the number of wire turns per layer multiplied by the number of layers. Given a uniform cross section for each antenna coil, the overlapping coils essentially double the thickness of the antenna at the cross-over point. An antenna with a thick center is undesirable for highly aesthetic, low visual mass antennas. A thin antenna with uniform antenna thickness along the antenna height is preferable.

BRIEF SUMMARY OF THE INVENTION

An EAS antenna having uniform antenna thickness along the antenna height can be achieved if the individual coil cross-sections are variable with respect to the circumference. If the individual coil thickness is halved at the overlap, the antenna will have uniform thickness along the antenna height. This is accomplished by reducing the number of wire turns per layer along one or more sections of the coil, and simultaneously increasing the number of wire layers on the same sections.

In a first aspect of the invention, an electronic article surveillance antenna has a coil loop defined by a plurality of windings of a wire forming a loop. The coil loop has a first end and a second end, where a cross-section of the coil loop varies from the first end to the second end. The cross-section is defined by the number of windings of wire per a layer of the coil and the number of the layers per end.

The antenna can further include a second coil loop defined by a second plurality of windings of a second wire forming a second loop. The second coil loop has a first end and a second end, where a cross-section of the second coil loop varies from the first end to the second end. The cross-section of the second coil loop is defined by the number of windings of the second wire per a layer of the second coil and the number of the layers per end. The first ends of the first and the second coil loops are thinner than the second ends of the first and the second coil loops. The first and second coil loops are disposed in overlapping orientation with each other near the first ends, resulting in an antenna that is relatively uniform in thickness.

The first end of the first coil loop can consist of two windings of the first wire and eight layers, and the second end of the first coil loop can consist of four windings of the first wire and four layers. The first end of the second coil loop can consist of two windings of the second wire and eight layers, and the second end of the second coil loop can consist of four windings of the second wire and four layers.

In a second aspect of the invention, a method of winding a pair of overlapping coil loops to define an electronic article surveillance antenna having a substantially relatively uniform thickness dimension from end to end includes winding a first wire a plurality of windings to define a coil loop having a first end and a second end where the first end is thinner in cross-section that the second end. Then, winding a second wire a plurality of windings to define a second coil loop having a first end and a second end where the first end is thinner in cross-section that the second end. Finally, positioning the first coil loop and the second coil loop where the first ends overlap with each other forming an electronic article surveillance antenna with a substantially relatively uniform thickness.

Winding the first wire to form the first end to consist of two windings and eight layers of the first wire, and the second end to consist of four windings and four layers of the first wire. And, winding the second wire to form the first end to consist of two windings and eight layers of the second wire, and the second end to consist of four windings and four layers of the second wire.

Objectives, advantages, and applications of the present invention will be made apparent by the following detailed description of embodiments of the invention.

DETAILED DESCRIPTION OF THE INVENTION

EAS antenna coils, which emit an electromagnetic field, are commonly constructed of an individual wire that is wound around a coil mandrel. The characteristics of the mandrel core, such as size and shape determine the final geometry of the antenna. The antenna coil is built by revolving the mandrel about a central axis as the wire is drawn around it. The number of revolutions, or total number of turns, effects the overall size of the antenna coil cross-sectional area. The thickness of the antenna coils is determined by the spacing between two side plates in the mandrel. These side plates contain the wire as it is wound around the mandrel core. The winding of the wire typically commences along one side plate where the wire remains adjacent to the said side plate for the full revolution of the mandrel. In subsequent revolutions (turns) the wire is laid adjacent to the previous wind, until the entire row reaches the other side plate, and a layer of the coil is complete. A given side plate spacing and wire size determines the number of turns that is achievable for a given row. The second and subsequent rows are built by continuing the winding process, until the required total number of turns is achieved.

The number of turns per layer can be reduced for a portion of the antenna coil circumference if the spacing between the mandrels varies for each coil section. The sections with the greater spacing will accommodate more turns per layer and result in a thicker coil. As the mandrel side plate spacing decreases for other coil sections, the number of turns per layer and coil thickness will decrease and the number of layers will increase, thus developing a non-uniform coil cross-section per unit length of circumference. Any number of turns can be utilized to form coils of varying cross-sectional thickness. A specific example is illustrated hereinbelow.

Figure 1:
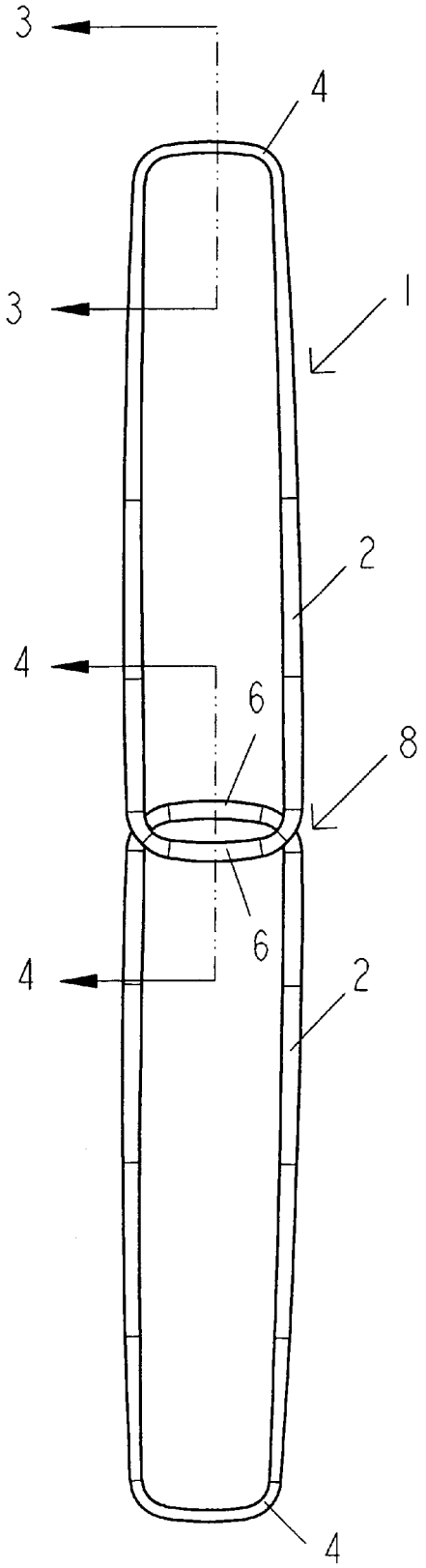
FIG. 1 is a front elevation view of one embodiment of the present invention.
Figure 2:
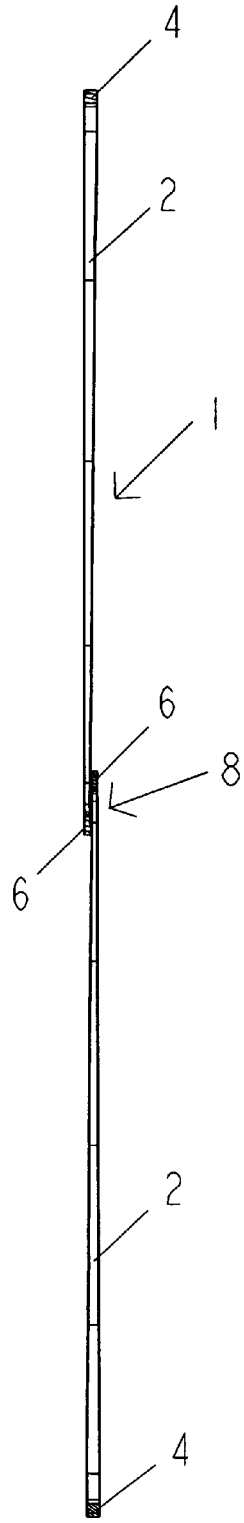
FIG. 2 is a side elevation view of that in FIG. 1.

Referring to FIGS. 1 and 2, an EAS antenna 1 is illustrated having two coils 2 each having a first end 4 and a second end 6. The coils 2 are positioned end 6 to end 6 where ends 6 of each coil 2 overlap, or cross-over, in antenna region 8. Referring to FIG. 2, the thickness of coil ends 6 are thinner than coil ends 4 resulting in an overall antenna 1 thickness that is substantially relatively uniform from end to end.

Figure 4:
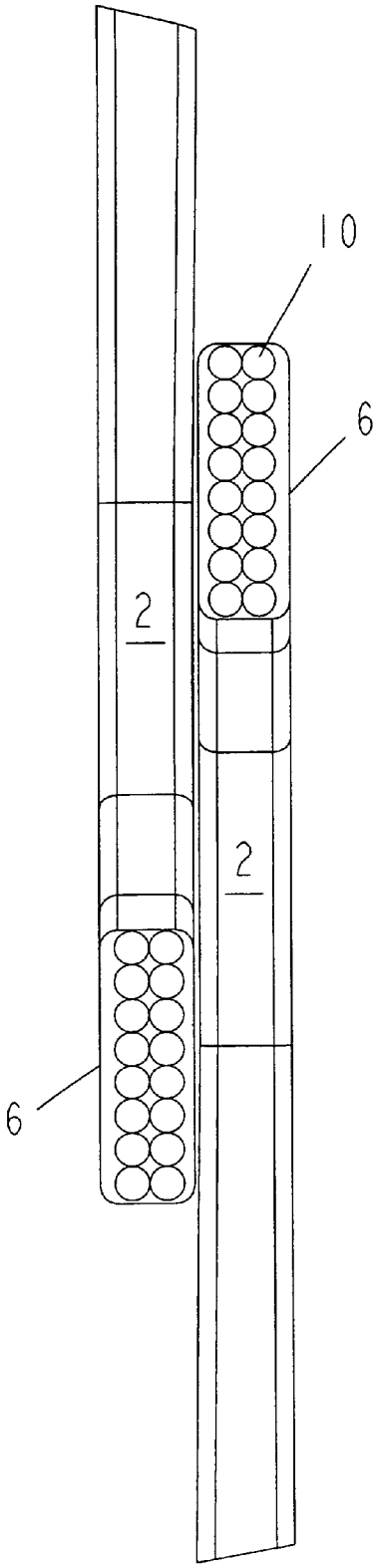
FIG. 4 is a partial cross-sectional view taken along line 4—4 in FIG. 1.
Figure 3:
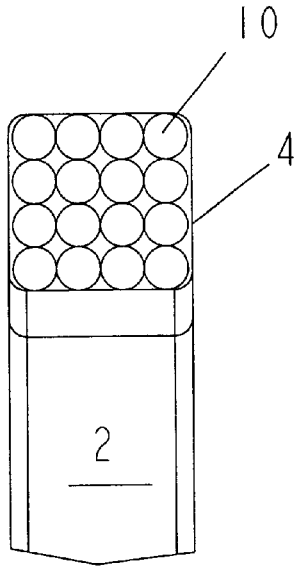
FIG. 3 is a partial cross-sectional view taken along line 3—3 in FIG. 1.

Referring to FIGS. 3 and 4, the cross-section of end 4 and end 6, respectively, of coil 2 is illustrated. At end 4, wire 10 is wound four turns per layer, with four layers resulting in a square cross-section. At end 6, wire 10 is wound two turns per layer resulting in 8 layers with a corresponding thinner rectangular cross-section. When coils 2 overlap at ends 6, which have thinner cross-sections, the overall thickness of antenna 1 is nearly uniform from end to end. In conventional coil winding, the coil would have a square profile throughout, resulting in a thicker cross-over region producing an antenna with a thicker center region.

Winding a coil with a varying cross-section can be used in any EAS coil loop in which a variation in antenna thickness from end to end is desired. A plurality of coil loops, or one coil loop, of varying cross-section is contemplated herein. In addition, one or more coil loops with varying cross-sectional area in combination with one or more coil loops having uniform cross-sectional area is contemplated herein.

It is to be understood that variations and modifications of the present invention can be made without departing from the scope of the invention. It is also to be understood that the scope of the invention is not to be interpreted as limited to the specific embodiments disclosed herein, but only in accordance with the appended claims when read in light of the forgoing disclosure.

What is claimed is:

1. An electronic article surveillance antenna, comprising a first coil defined by a first plurality of windings of a first wire, said first coil having a first end and a second end, wherein a cross-section of said first coil varies from said first end to said second end, the cross-section defined by the number of windings of the first wire per a layer of said first coil and the number of said layers per end;

a second coil defined by a second plurality of windings of a second wire, said second coil having a first end and a second end, wherein a cross-section of said second coil varies from said first end to said second end, the cross-section of said second coil defined by the number of windings of the second wire per a layer of said second coil and the number of said layers per end, wherein said first ends of said first and said second coils being thinner than said second ends of said first and said second coils, said first and said second coils disposed in overlapping orientation with each other near said first ends, wherein said antenna is relatively uniform in thickness.

2. The antenna according to claim 1, wherein said first end of said first coil consists of two windings of the first wire and eight layers, and said second end of said first coil consists of four windings of the first wire and four layers, and wherein said first end of said second coil consists of two windings of the second wire and eight layers, and said second end of said second coil consists of four windings of the second wire and four layers.

3. A method of winding a pair of overlapping coils to define an electronic article surveillance antenna having a substantially relatively uniform thickness dimension from end to end, comprising:

winding a first wire a plurality of windings to define a first coil having a first end and a second end, wherein said first end is thinner in cross-section that said second end;

winding a second wire a plurality of windings to define a second coil having a first end and a second end, wherein said first end is thinner in cross-section thin said second end; positioning said first coil and said second coil wherein said first ends overlap with each other forming an electronic article surveillance antenna having a substantially relatively uniform thickness.

4. The method of claim 3 further comprising;

winding said first wire wherein said first end consists of two windings and eight layers of said first wire, and said second end consists of four windings and four layers of said first wire; and, winding said second wire wherein said first end consists of two windings and eight layers of said second wire, and said second end consists of four windings and four layers of said second wire.

* * * * *